US006697060B1

(12) United States Patent
Tsuchiya

(10) Patent No.: US 6,697,060 B1
(45) Date of Patent: Feb. 24, 2004

(54) LIQUID-CRYSTAL DISPLAY, ELECTRONIC DEVICE, AND POWER SUPPLY CIRCUIT FOR DRIVING LIQUID-CRYSTAL DISPLAY

(75) Inventor: Masahiko Tsuchiya, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/623,625

(22) PCT Filed: Jan. 7, 2000

(86) PCT No.: PCT/JP00/00037

§ 371 (c)(1),
(2), (4) Date: Oct. 30, 2000

(87) PCT Pub. No.: WO00/41027

PCT Pub. Date: Jul. 13, 2000

(30) Foreign Application Priority Data

Jan. 8, 1999 (JP) ..... 11-002906

(51) Int. Cl.[7] ..... G09G 5/00

(52) U.S. Cl. ..... 345/212; 345/95; 323/225; 323/297

(58) Field of Search ..... 345/87, 95, 204, 345/210, 211–213; 323/225, 297

(56) References Cited

U.S. PATENT DOCUMENTS 5,229,761 A 7/1993 Fuse
5,343,221 A * 8/1994 Arakawa et al. ..... 345/211
5,510,748 A * 4/1996 Erhart et al. ..... 327/530
5,745,092 A * 4/1998 Ito ..... 345/95
5,859,632 A * 1/1999 Ito ..... 345/211
6,236,394 B1 5/2001 Ikeda
2002/0154109 A1 * 10/2002 Ikeda ..... 345/211

FOREIGN PATENT DOCUMENTS

WO WO 98/35430 8/1998
WO WO 98/44621 10/1998

* cited by examiner

*Primary Examiner*—Bipin Shalwala
*Assistant Examiner*—Ricardo Osorio
(74) *Attorney, Agent, or Firm*—Oliff & Berridge, PLC

(57) ABSTRACT

A power supply circuit for generating potentials used to drive a liquid crystal, has first to fourth switches (101 to 104) connected in series between a high potential line (105) and a low potential line (106). The first to fourth switches are turned on and off by a switch drive circuit (107) so that the period of time in which the first and third switches are on and the period of time in which the second and fourth switches are on alternate. The power'supply circuit also has the first to third capacitors (111 to 113) of which the state of connection is switched alternately between serial and parallel by the switching operation of the switches. The potential between the second and third switches converges the middle potential between the potentials of the high and low potential lines by the alternate switching between series and parallel connections of the third capacitor (113) to the first and second capacitors (111, 112).

10 Claims, 12 Drawing Sheets

LIQUID-CRYSTAL DISPLAY, ELECTRONIC DEVICE, AND POWER SUPPLY CIRCUIT FOR DRIVING LIQUID-CRYSTAL DISPLAY

TECHNICAL FIELD

The present invention relates to a power supply circuit for generating potentials required for driving a liquid crystal, and to a liquid crystal device and an electronic device using same.

BACKGROUND OF ART

FIG. 20 is the configuration of a conventional power supply circuit for generating potentials required for driving a liquid crystal by resistance division. The first to fifth resistors R1 to R5 are connected in series across a first potential-supply line 401 supplying a high potential V0 and a second potential-supply line 402 supplying a low potential V5. Potentials V1 to V4 between V0 and V5 are generated by dividing the potential difference (V0–V5) between the first and second potential-supply lines by resistors R1 to R5.

These potentials V0 to V5 are used as the potentials of common signals COM0, COM1, COM2, and so on applied to common electrodes that are scanning electrodes and of segment signals SEGn applied to segment electrodes that are signal electrodes, as shown in FIG. 16. In the example shown in FIG. 20, potentials V0 and V5 become select potentials of common signals, and potentials V1 and V4 become non-select potentials of common signals. Potentials V0 and V5 become, for example, on-potentials of segment signals, and potentials V2 and V3 become, for example, off-potentials of segment signals.

When potentials V1 to V4 are generated by resistor division as shown in FIG. 20, the current driving capability of a power supply circuit is dependent on the values of the resistors used for dividing voltage. Although a power supply circuit for driving a liquid crystal needs a current driving capability according to the load (liquid crystal) driven by it, the current driving capability of a power supply circuit is limited by the resistors used. In particularly, when the values of the resistors are large and the load of the crystal to be driven is large, the potentials generated by resistor division vary beyond permissible limits. As a result, the liquid crystal display device does not produce a normal display. For a liquid crystal display device to make normal display even in the case where the load to drive the liquid crystal display is large, the current driving capability of a power supply circuit must be increased. This requires the values of the resistors to be decreased. However, decreasing the values of the resistors for resistor increases the power consumption in the power supply circuit.

FIG. 21 is the circuit diagram of another conventional power supply circuit for driving a liquid crystal device, and differs from the power supply circuit of FIG. 20 in that voltage-follower operational amplifiers 403 to 406 are respectively connected to the output lines of potentials V1 to V4. The voltage-follower operational amplifiers 403 to 406 perform impedance conversion and output of the input potentials V1 to V4.

Although the circuit of FIG. 21 can decrease the power consumption by the resistors for resistor division, this circuit requires four voltage-follower operational amplifiers 403 to 406. Furthermore, this operational amplifier has a large power consumption because of requirement of a specific circuit configuration such as differential pair or the like.

An object of the present invention is therefore to provide a power supply circuit for driving a liquid crystal which can decrease the power consumption, and a liquid crystal device and an electronic device using same.

DISCLOSURE OF INVENTION

A first aspect of the present invention provides a power supply circuit for generating potentials used to drive a liquid crystal, the power supply circuit comprising:

first to fourth switches connected in series between a high potential line and a low potential line;

a switch drive circuit which drives the first to fourth switches so that the period of time in which the first and third switches are on and the period of time in which the second and fourth switches are on are alternate; and a plurality of capacitors of which connection state is switched alternately between series and parallel connections by a switching operation of the switch drive circuit,.

wherein a potential between the second and third switches converges a middle potential between potentials of the high and low potential lines by a switching operation of the switch drive circuit.

According to this aspect of the present invention, the amount of electric charge stored in the plurality of capacitors becomes stabilized because of the switching operation described above. Consequently, the potential between the second and third switches converges the middle potential between the potential difference of the high and low potential lines.

Since no current flows through the circuit when the amount of electric charge stored in the capacitors becomes stabilized, the power consumption can be decreased. In addition, because the potentials become stabilized without being affected by the variation in the capacitances of the plurality of capacitors, an accurate potential can be generated.

When first to third midpoints are midpoints of switch-intervals formed by being divided by the first to fourth switches, the power supply circuit may comprise:

a first capacitor connected between the high potential line and the second midpoint;

a second capacitor connected between the second midpoint and the low potential line; and a third capacitor connected between the first midpoint and the third midpoint.

By connecting the three capacitors in this manner, the connection of the third capacitor to the first and second capacitors is alternately switched between series and parallel connections by the above-described switching operation.

In this configuration, the first and second capacitors may be replaced by capacitors of a liquid crystal layer formed by supplying potentials of the high and low potential lines and the second midpoint to the liquid crystal layer.

The plurality of capacitors may also be formed of a first capacitor connected between the high potential line and the second midpoint; and a second capacitor connected between the first midpoint and the third midpoint. Further, the plurality of capacitors may also be formed of a first capacitor connected between the second midpoint and the low potential line; and a second capacitor connected between the first midpoint and the third midpoint.

In either configuration, the connection of the first and second capacitors is switched alternately between series connection and parallel connection.

Another aspect of the present invention provides a power supply circuit for generating potentials used to drive a liquid crystal, the power supply circuit comprising: a main power supply circuit generating a potential between potentials of a first potential-supply line and a second potential-supply line; a first sub-power supply circuit generating a potential between potentials of the first potential-supply line and an output line of the main power supply circuit; and a second sub-power supply circuit generating a potential between potentials of the output line of the main power supply circuit and the second potential-supply line. The power supply circuit described above may be used for at least one of the main power supply circuit and the first and second sub-power supply circuits.

By using the power supply circuit described above for all of the main power supply circuit and the first and second sub-power supply circuits, five-level liquid crystal drive potentials V0 to V4 used for a ¼ bias driving method can be accurately generated.

To generate liquid crystal drive potentials used for a bias driving method of ¼ or less, for example, six-level potentials V0 to V5, it is preferable to use a resistor division method for the main power supply circuit for generating two-level potentials V2 and V3 between the high potential V0 and the low potential V5 and use the potentials V2 and V3 impedance-convert through impedance-conversion circuits (formed of an operational amplifier, for example). In this case, the first sub-power supply circuit generates a potential V1 between the potentials V0 and V2, and the second sub-power supply circuit generates a potential V4 between the potentials V3 and V5.

By this configuration, compare to a conventional power supply circuit which needs four operational amplifiers to generates a potential of liquid crystal, present invention can omit two operational amplifiers. As a result, the manufacturing cost can be decreased because of the reduced chip size. Electric power consumption may also be decreased.

P-type MOS transistors can be used for a first to fourth switches (sub-switches) in the second sub-power supply circuit. In addition, N-type MOS transistors can be used for a fifth to eighth switches (sub-switches) in the second sub-power supply circuit.

The switching operation described above is made possible by applying the high potential V0 and the low potential V5 (both potentials are the select potential of the scanning signal) alternately to the gate of the P-type MOS and N-type MOS transistors.

Since this configuration makes it possible to apply a greater voltage between the source and gate, transistors of the same performance can be made in a smaller size. Consequently, the manufacturing cost of the power supply circuit can be decreased because of the reduced chip size.

A liquid crystal device of the present invention and an electronic device having the liquid crystal device of the present invention include the power supply circuit for a liquid crystal described above. Since the power supply circuit of the present invention can reduce the power consumption of the liquid crystal device, it is particularly useful for portable electronic devices.

BEST MODE FOR CARRYING OUT THE INVENTION

Embodiments of the present invention will be explained with reference to the drawings.

Figure 1:
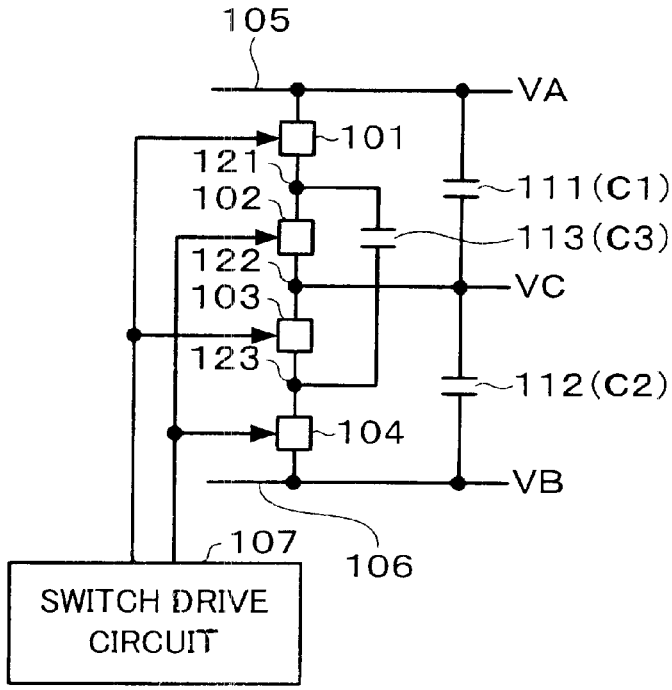
FIG. 1 is a circuit diagram showing an example of a main part of the power supply circuit for driving a liquid crystal of the present invention.

Description of Main Part of the Power Supply Circuit for Driving a Liquid Crystal FIG. 1 is a circuit diagram that shows the configuration of the main part of the power supply circuit for driving a liquid crystal of the present invention. In FIG. 1, first to fourth switches 101 to 104 are connected in series between a first potential-supply line 105 and a second potential-supply line 106.

These first to fourth switches 101 to 104 are turned on or off by a switch drive circuit 107. The switch drive circuit 107 drives the first to fourth switches 101 to 104 so that the period of time during which the first and third switches 101 and 103 are on and that during which the second and fourth switches 102 and 104 are on alternately repeated.

A plurality of capacitors, for example three, first to third capacitors 111 to 113, are disposed in the circuit so that the connection among them is switched between series and parallel by the switching operation of the switch drive circuit 107. The values of the first to third capacitors 111, 112, and 113 are respectively denoted by C1, C2, and C3.

Midpoints on the intervals between adjacent switches, separated by the first to fourth switches 101 to 104 are referred to as first to three midpoints 121, 122, and 123 as shown in FIG. 1. The first capacitor 111 is connected between the first potential-supply line 105 and the second midpoint 122. The second capacitor 112 is connected between the second midpoint 122 and the second potential-supply line 106. The third capacitor 113 is connected between the first and third midpoints 121,and 123.

In this power supply circuit, potentials VA and VB on the first and second potential-supply lines 105 and 106 and a potential VC at the second midpoint 122 are output.

Figure 2:
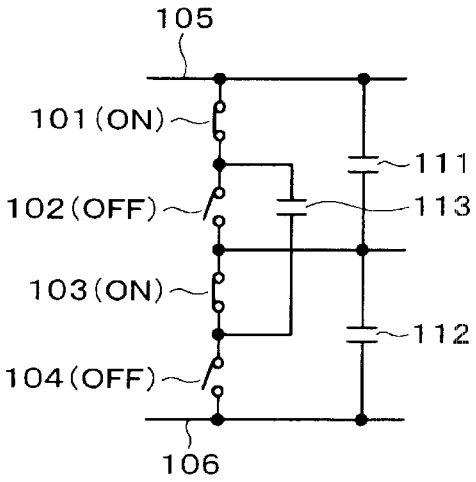
FIG. 2 is a circuit diagram showing a first state of the circuit shown in FIG. 1.
Figure 3:
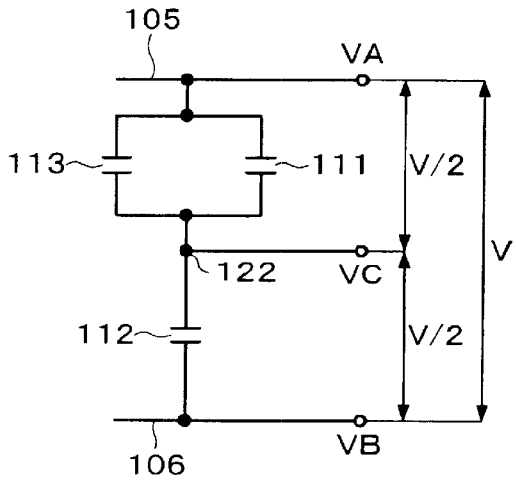
FIG. 3 is an equivalent circuit diagram of the first state shown in FIG. 2.

FIG. 2 is a circuit diagram in a first state in which the first and third switches 101 and 103 are being turned on and the second and fourth switches 102 and 104 are being turned off in the circuit shown in FIG. 1. FIG. 3 is an equivalent circuit diagram of the circuit shown in FIG. 2.

Figure 4:
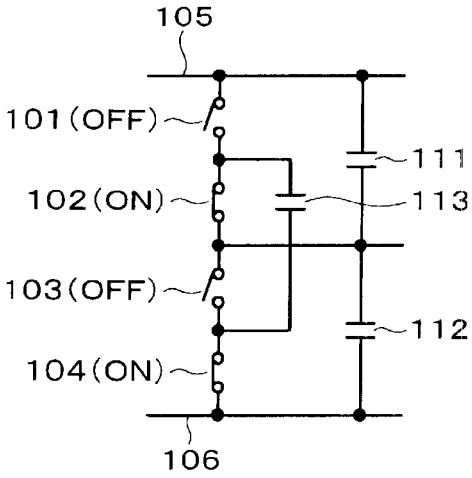
FIG. 4 is a circuit diagram showing a second state of he circuit shown in FIG. 1.
Figure 5:
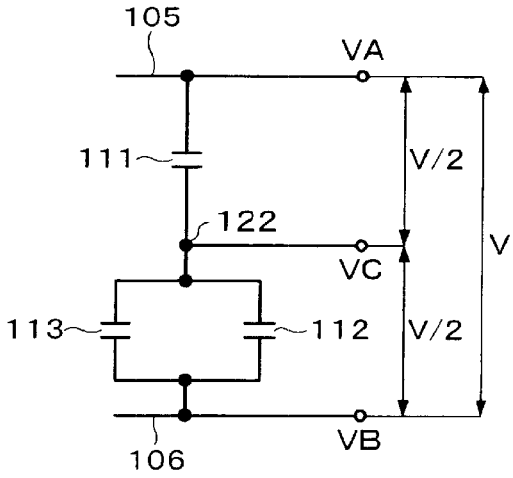
FIG. 5 is an equivalent circuit diagram of the second state shown in FIG. 4.

Similarly, FIG. 4 is a circuit diagram in the second state in which the first and third switches 101 and 103 are being turned off and the second and fourth switches 102 and 104 are being turned on in the circuit shown in FIG. 1. FIG. 5 is an equivalent circuit diagram of the circuit shown in FIG. 4.

As known from a comparison of FIGS. 3 and 5, the configurations in both the first and second states are the same inasmuch as the first and second capacitors 111 and 113 are connected in series between the first and second potential-supply lines 105 and 106. The third capacitor 113 is connected in parallel to the first capacitor 111 in the first state and to the second capacitor 112 in the second state.

As for the relationship between the first and third capacitors 111 and 113, the third capacitor 113 is connected to the first capacitor 111 in parallel in the first state, and in series in the second state.

As for the relationship between the second and third capacitors 112 and 113, the third capacitor 113 is connected to the second capacitor 112 in series in the first state, and parallel in the second state.

In this manner, the connection of the third capacitor 113 to the first and second capacitors 111 and 112 is alternately switched between series and parallel by the switching operation of the switch drive circuit 107.

By this alternation of the first and second states, the amount of electric charge stored in the first to third capacitors 111 to 113 is stabilized so that the voltages applied to both ends of the first to third capacitors 111 to 113 become equal.

Here, it is assumed that the potential difference between the first and second potential-supply lines 105 and 106 is V. As the amount of electric charge stored in the first to third capacitors 111 to 113 is stabilized from the switching operation of the switch drive circuit 107, the potential VC at the second midpoint 122 between the second and third switches 102 and 103 converges the middle potential (V/2) of the potential difference V between the first and second potential-supply lines 105 and 106.

When the amount of electric charge stored in the first to third capacitors 111 to 113 has been stabilized, the electric current that flows among the first to third capacitors 111 to 113 becomes zero, and the electric current which flows thereafter is only the electric current used for the switching operation of the first to fourth switches 101 to 104. Consequently, the current consumption can be decreased.

When driving a liquid crystal device in which potentials VA, VB, and VC are being supplied from this power supply circuit to the liquid crystal device, the charging and discharging current at the liquid crystal device, which is the minimum current required to drive the liquid crystal device, is the current consumed. If the potential VC at the second midpoint is kept stable, the current consumption can also be decreased when driving a liquid crystal device.

Further, in the power supply circuit shown in FIG. 1, the potential VC at the second midpoint 122 is accurately set to the middle value of the potential difference between the first and second potential-supply lines 105 and 106 by the switching operation described above, even if the capacitances C1, C2, and C3 of the first to third capacitors 111 to 113 deviate from the design values. Accordingly, the power supply circuit can generate a more accurate potential than the conventional resistance dividing method.

Although the first to third capacitors 111 to 113 are shown as single capacitors in the above description, the first capacitor 111, for example, may be made up of a plurality of capacitors. The second and third capacitors 112 and 113 may also be made up of a plurality of capacitors.

When using the power supply circuit shown in FIG. 1 to drive a simple matrix-type liquid crystal device, for example, the potentials of the first and second potential-supply lines 105 and 106 are applied to the segment electrodes, and the potential at the second midpoint 122 is applied to the common electrodes.

Since the segment electrodes and the common electrodes are disposed so as to face each other across the liquid crystal, liquid crystal capacitors CCL are formed by the electrodes and liquid crystal.

Figure 6:
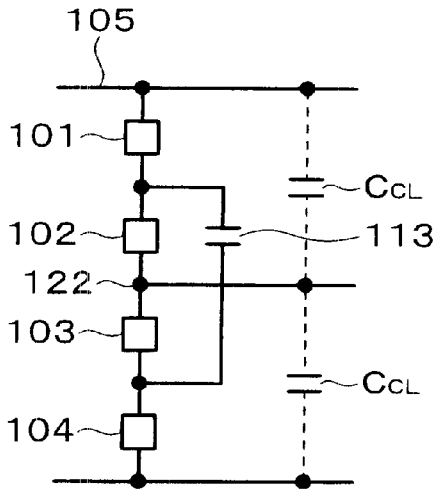
FIG. 6 is a circuit diagram in which some of the capacitors in the circuit shown in FIG. 1 are replaced by liquid crystal capacitors.

Therefore, the power supply circuit of FIG. 1 can be modified to the circuit shown in FIG. 6. In the power supply circuit shown in FIG. 6, the first and second capacitors 111 and 112 are not provided physically and replaced by the liquid crystal capacitors CCL.

In the power supply circuit of FIG. 6, the equivalent circuits shown in FIGS. 3 and 5 are realized alternately by repetition of the same switching operation as in the circuit of FIG. 1, thereby the middle potential (V/2) of the potential difference V between the first and second potential-supply lines 105 and 106 can be output from the second midpoint 122.

Figure 7:
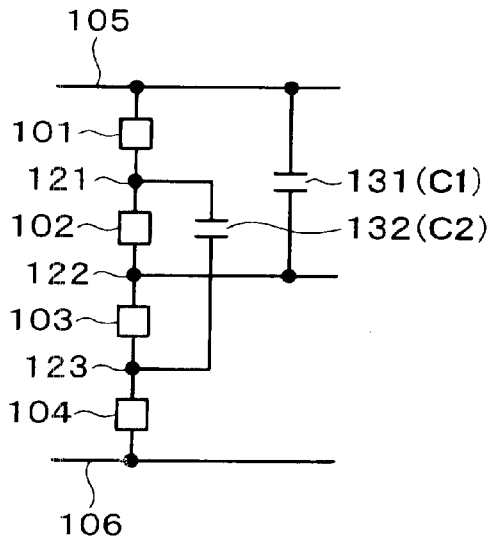
FIG. 7 is a circuit diagram showing another example of a main part of the power supply circuit for driving a liquid crystal of the present invention.
Figure 10:
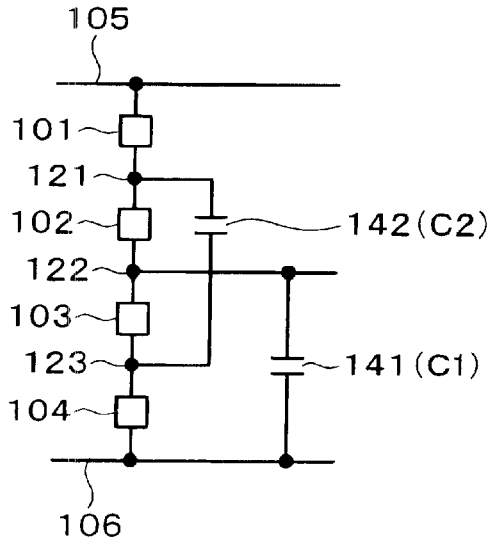
FIG. 10 is a circuit diagram showing still another example of a main part of the power supply circuit for driving a liquid crystal of the present invention.

A plurality of capacitors for which the connection can be switched alternately between series connection and parallel connection by the switch drive circuit 107 may be formed by the first and second capacitors shown in FIG. 7 or FIG. 10.

Although there are no specific limitations to the capacitances C1, C2, and C3 of the first to third capacitors 111 to 113, it is preferable for the stability of the above-described operation that the capacitances C1 and C2 be substantially equal and the capacitance C3 be not excessively large.

In FIG. 7, a first capacitor 131 is connected between the first potential-supply line 105 and the second midpoint 122, and a second capacitor 132 is connected between the second and third midpoints 122 and 123.

In FIG. 10, a first capacitor 141 is connected between the second potential-supply line 106 and the second midpoint 122, and a second capacitor 142 is connected between the second and third midpoints 122 and 123.

Figure 8:
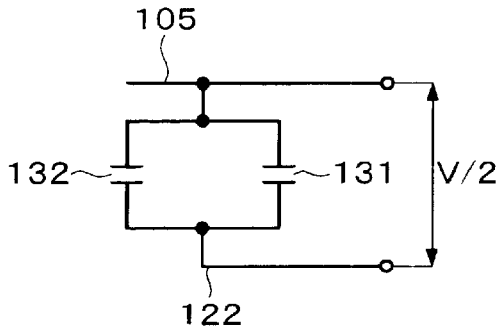
FIG. 8 is an equivalent circuit diagram of a first state in the circuit shown in FIG. 7.
Figure 9:
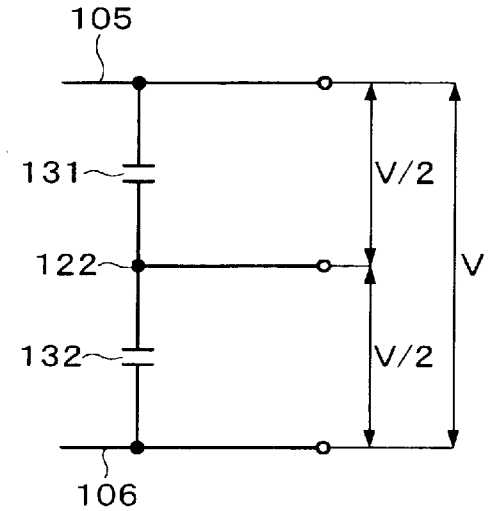
FIG. 9 is an equivalent circuit diagram of a second state in the circuit shown in FIG. 7.
Figure 11:
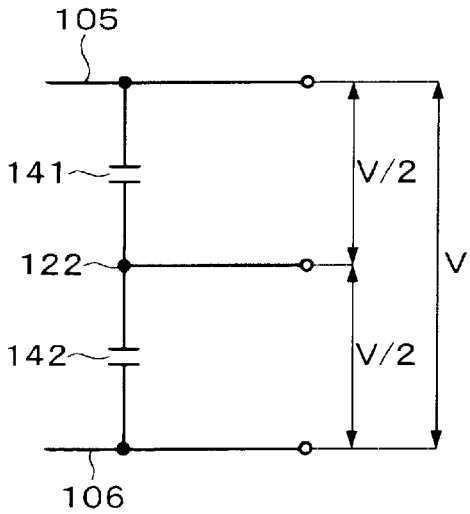
FIG. 11 is an equivalent circuit diagram of a first state in the circuit shown in FIG. 10.
Figure 12:
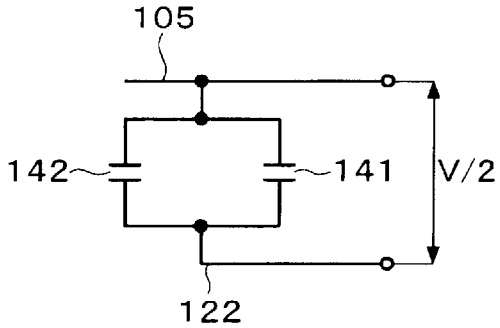
FIG. 12 is an equivalent circuit diagram of a second state in the circuit shown in FIG. 10.

FIGS. 8 and 9 are equivalent circuits of the first and second states of the power supply circuit of FIG. 7. FIGS. 11 and 12 are equivalent circuits of the first and second states of the power supply circuit of FIG. 10.

When the first to fourth switches 101 to 104 are driven to perform the switching operation in the power supply circuit of FIG. 7 in the same manner as in FIG. 1, the first and second capacitors 131 and 132 are connected in parallel in the first state, and are connected in series in the second state as shown in FIGS. 8 and 9.

Likewise, when the first to fourth switches 101 to 104 are driven to perform the switching operation in the power supply circuit of FIG. 10 in the same manner as in FIG. 1, the first and second capacitors 141 and 142 are connected in series in the first state, and are connected in parallel in the second state as shown in FIGS. 11 and 12. voltages applied to both ends of the first and second capacitors become equal because the first and second capacitors are connected in parallel as shown in FIGS. 8 and 12, respectively. Since the voltages applied to the first and second capacitors become stable so as to enable the first and second capacitors to maintain the electric charges charged at this time, the potential at the second midpoint 122 converges the middle potential (V/2) of the potential difference V between the first and second potential-supply lines 105 and 106.

Description of Power Supply Circuit for Driving a Liquid Crystal

Figure 13:
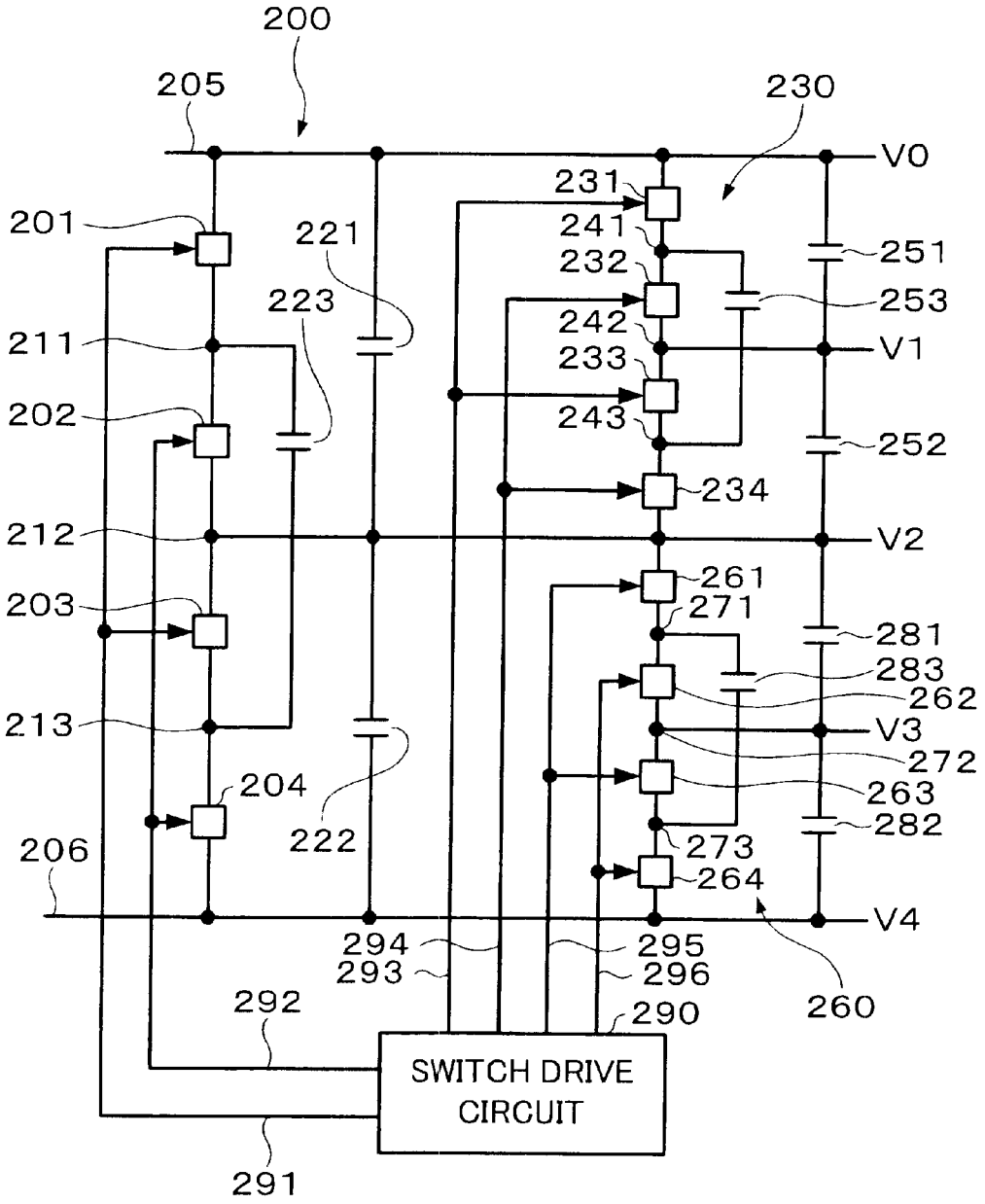
FIG. 13 is a circuit diagram of the power supply circuit for driving a liquid crystal according to an embodiment of the present invention formed by combining the circuit components shown in FIG. 1.
Figure 14:
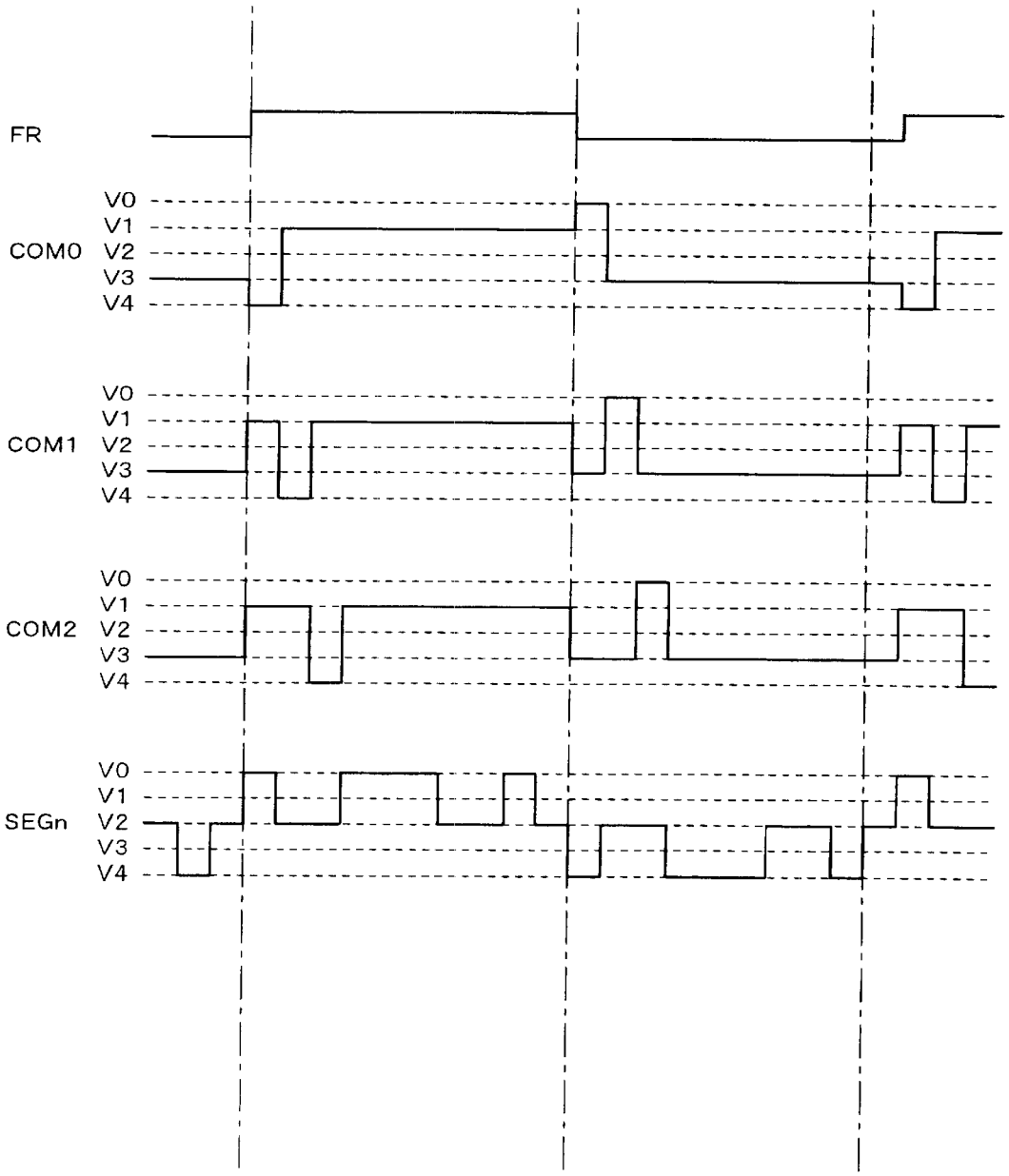
FIG. 14 is a waveform diagram of the liquid crystal drive signals of the potentials generated by the power supply circuit shown in FIG. 13.

Next, a power supply circuit for driving a liquid crystal using the power supply circuit shown in FIG. 1 will be described by referring to FIGS. 13 and 14. FIG. 13 is the circuit diagram of a power supply circuit which is formed by combining the three power supply circuits of FIG. 1 and drives a liquid crystal by the ¼ bias driving method. FIG. 14 shows common signals COM0 to COM2 which are scanning signals with the potential supplied from the power supply circuit of FIG. 13, and segment signals SEGn as the data signal.

This power supply circuit for driving a liquid crystal, as shown in FIG. 13, comprises a main power supply circuit 200, a first sub-power supply circuit 230 second sub-power supply circuit 260, and switch drive circuit 290.

The main power supply circuit 200 has first to fourth main switches 201 to 204 connected in series between a first potential-supply line 205 and a second potential-supply line 206. Points separated by the main switches 201 to 204 are referred to as first to third main midpoints 211 to 213. This main power supply circuit 200 has first group of capacitors including a first to third main capacitors 221 to 223 for which the connection is switched alternately between parallel and serial connections by the switching operation of the first to fourth main switches 201 to 204. The connection of these first to third main capacitors 221 to 223 is the same as in FIG. 1.

The first sub-power supply circuit 230 has first to fourth sub-switches 231 to 234 connected in series between the first potential-supply line 205 and the second main midpoint 212. Points separated by the main switches 231 to 234 are referred to as first to third sub midpoints 241 to 243. This first sub-power supply circuit 230 has a second group of capacitors including first to third sub-capacitors 251 to 253 for which the connection is switched alternately between parallel and serial connections by the switching operation of the first to fourth sub-switches 231 to 234. The connection of these first to third sub capacitors 251 to 253 is the same as in FIG. 1.

The second sub-power supply circuit 260 has fifth to eighth sub-switches 261 to 264 connected in series between the second sub potential-supply line 206 and the second main midpoint 212. Points separated by the switches 261 to 264 are referred to as sub-midpoint midpoints 271 to 273. This second sub-power supply circuit 260 has a third group of capacitors including fourth to sixth sub-capacitors 281 to 283 for which the connection is switched alternately between parallel and serial connections by the switching operation of the fifth to eight sub-switches 261 to 264. The connection of these fourth to sixth sub capacitors 281 to 283 is the same as in Fig. 1.

The switch drive circuit 290 has switch drive signal lines 291 to 296 as output lines. These drive signal lines 291 to 296 drive the main power supply circuit 200 and the first and second sub-power supply circuits 230 and 260 with the same timing as in the power supply circuit shown in FIG. 1.

Here, the potentials of the first and second potential-supply lines 205 and 206 are denoted by V0 and V4, the potential at the second sub-midpoint 242 by V1, the potential at the second main midpoint 212 by V2, and the potential at the fifth sub-midpoint 272 by V3. This power supply circuit for driving a liquid crystal device outputs the potentials V0 to V4 described above.

The state of connection of the first to third main capacitors 221 to 223 of the main power supply circuit 200 alternates between the first state shown in FIG. 3 and the second state shown in FIG. 5, being driven by the switching operation of the switch drive circuit 290. Accordingly, the potential V2 at the second main midpoint 212 converges the middle value (V0–V4)/2 of the potential difference between the first and second potential-supply lines 205 and 206.

For the same reason, the potential V1 at the second sub-midpoint 242 converges the middle value (V0–V2)/2 of the potential difference between the first potential-supply lines 205 and the second main midpoint 212 because of the operation of the first sub-power supply circuit 230. Similarly, the potential V3 at the fifth sub-midpoint 272 converges the middle value (V2–V4)/2 of the potential difference between the second main midpoint 212 and the second potential-supply lines 206 because of the operation of the second sub-power supply circuit 260.

As a result, five potentials V0 to V4 such as V0–V1=V1–V2=V2–V3=V3–V=constant are generated.

Liquid crystal driving waveforms using these five potentials V0 to V4 are shown in FIG. 14. In FIG. 14, common signals COM0 to COM2 and segment signals SEGn for which the polarity of voltage applied to a liquid crystal is inverted at every frame by a polarity-inverting alternating signal FR are shown. Potentials V0 and V4 in the common signals are the select electric potential, and potentials V1 and V3 are the non-select electric potential. On the other hand, potentials V0 and V4 in the segment signals are the on-potentials, and potentials V1 and V3 are the off-potentials.

Description of Another Power Supply Circuit for Driving a Liquid Crystal

Figure 15:
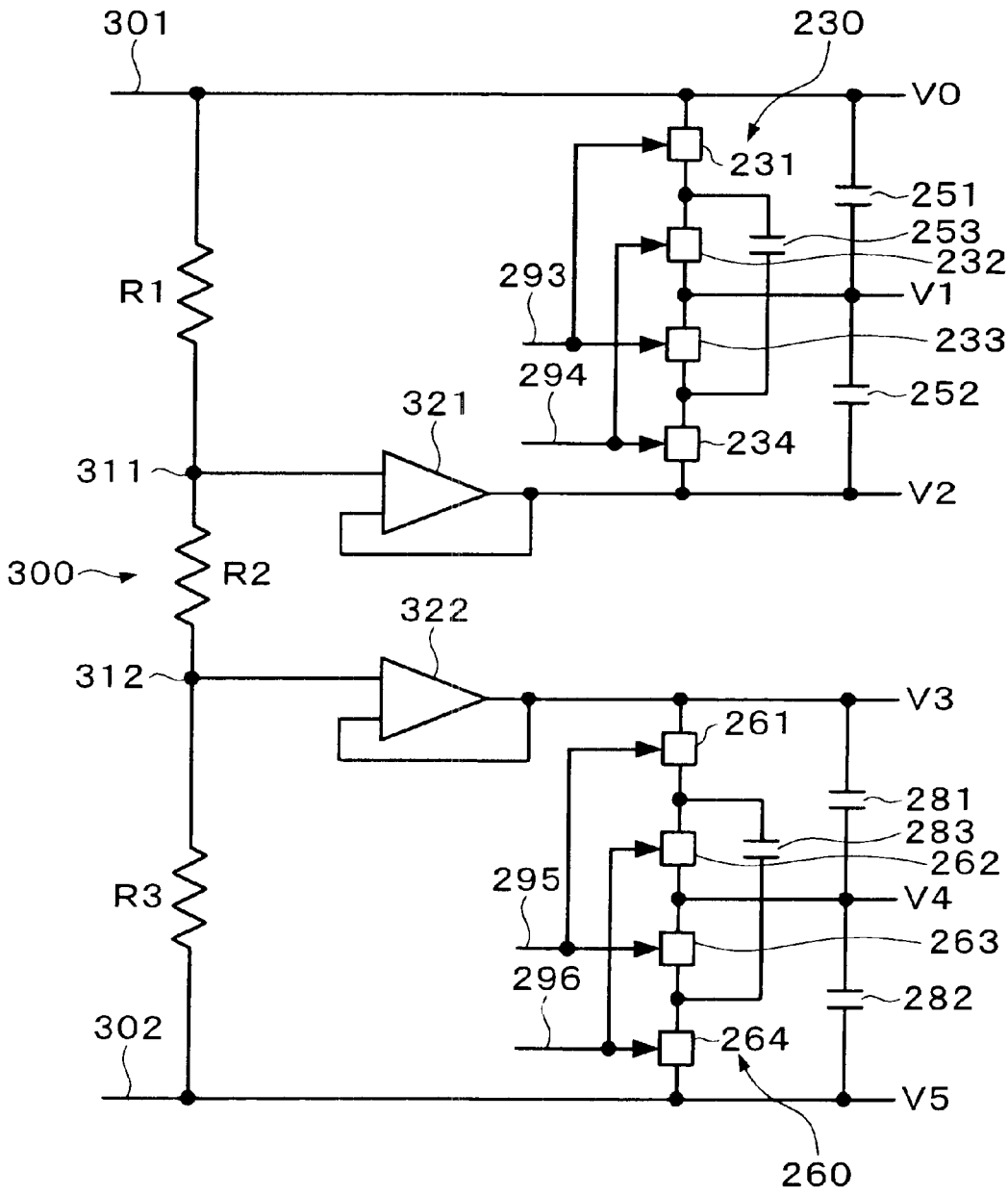
FIG. 15 is the circuit diagram of the power supply circuit for driving a liquid crystal according to another embodiment of the present invention.

FIG. 15 is a circuit diagram of a power supply circuit which generates liquid crystal driving potentials, e.g. six potentials V0 to V5 used by a bias driving method of ¼ or less. The power supply circuit for driving a liquid crystal of FIG. 15 uses a main power supply circuit 300 in place of the main power supply circuit 200 in FIG. 13, and the first and second sub-power supply circuits 230 and 260 in FIG. 13.

The main power supply circuit 300 has first to third resistors R1 to R3 connected in series between the first and second potential-supply lines 301 and 302. Midpoints separated by the first to third resistors R1 to R3 are referred to as a first and second main midpoints 311 and 312.

A first voltage-follower operational amplifier 321 is connected to the first main midpoint 311, and a second voltage-follower operational amplifier 322 is connected to the second main midpoint 312.

The first sub-power supply circuit 230 outputs the middle potential V1[V1=(V0–V2)/2] between the potential V0 of the first potential-supply line 301 and the output potential V2 of the first voltage-follower operational amplifier 321.

The second sub-power supply circuit 260 outputs the middle potential V4[V4=(V3–V5)/2] between the output potential V3 of the second voltage-follower operational amplifier 322 and the potential V5 of the second potential-supply line 302.

The first and second sub-power supply circuits 230 and 260 are the same as those in FIG. 13 in that they are driven by a switch drive circuit 290 with switch drive signal lines 293 to 296 (not shown in FIG. 15).

Figure 21:
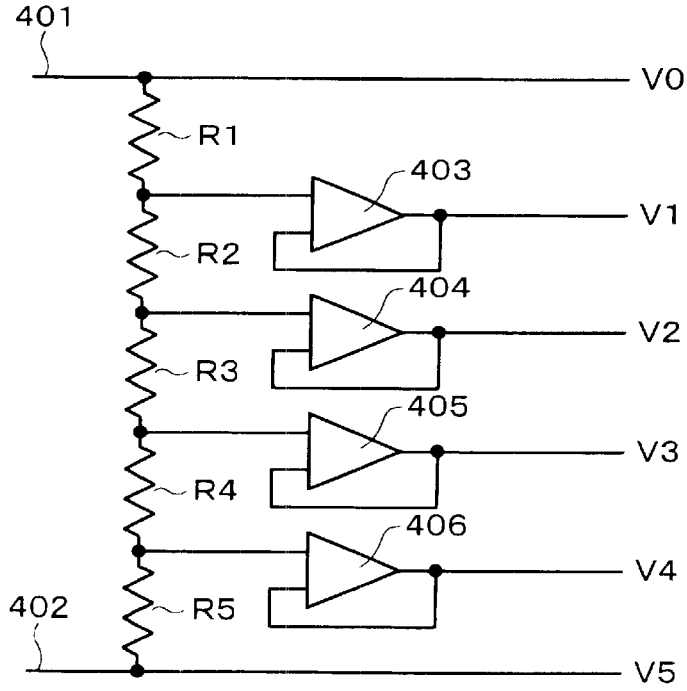
FIG. 21 is a circuit diagram of another conventional power supply circuit for driving a liquid crystal which has voltage-follower operational amplifiers connected to the outputs of the circuit shown in FIG. 20.

The power supply circuit shown in FIG. 15 has lower current consumption than the conventional art shown in FIG. 21 by about an amount equivalent to the current consumed by two operational amplifiers. The current consumption can be reduced to about half that of the conventional art.

Figure 16:
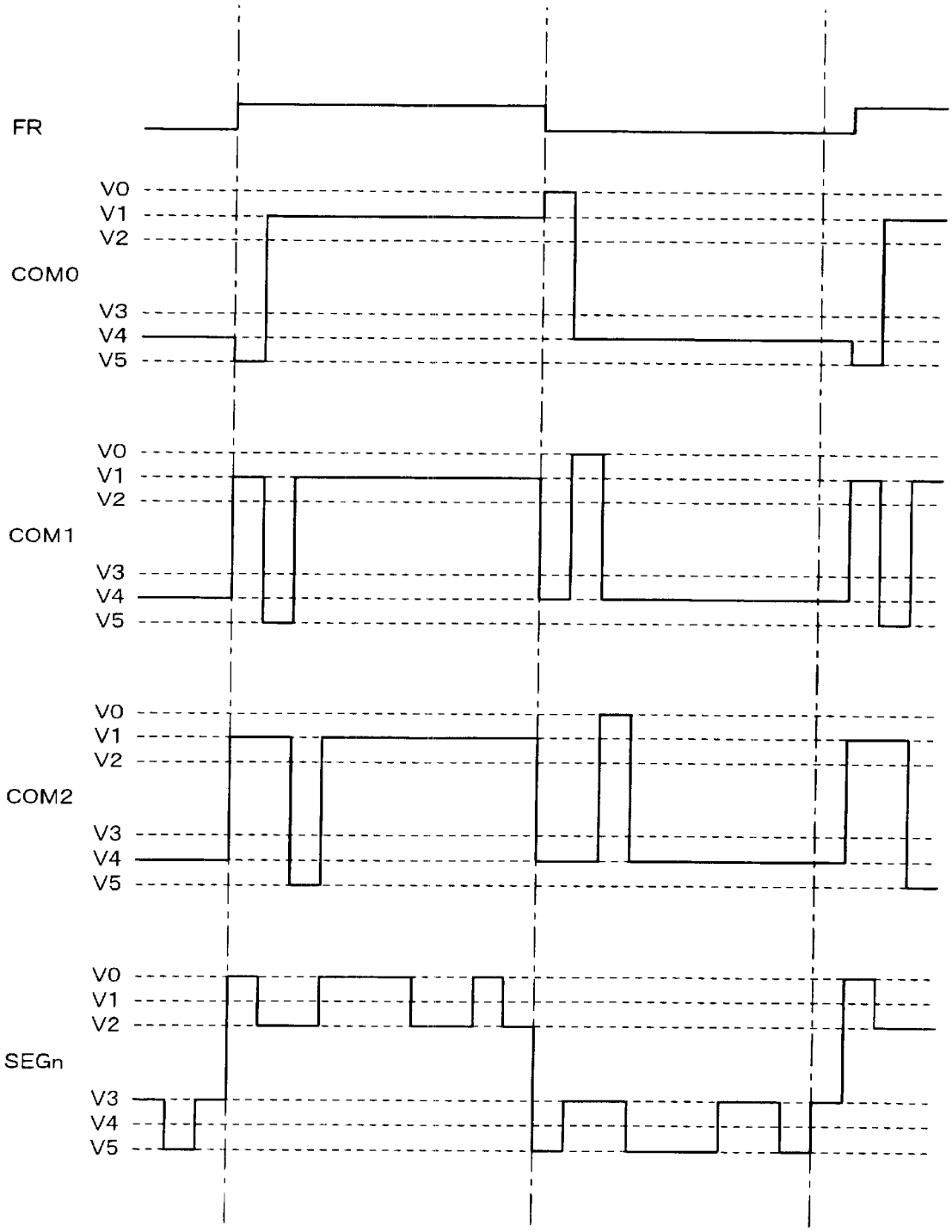
FIG. 16 is a waveform diagram of the liquid crystal drive signals of the potentials generated by the power supply circuit shown in FIG. 15.

Waveforms for driving a liquid crystal device using the six levels of potentials V0 to V5 are shown in FIG. 16. In FIG. 16, common signals COM0 to COM2 and segment signals SEGn for which the polarity of voltage applied to a liquid crystal is inverted at every frame by a polarity-inverting alternating signal FR are shown.

Figure 17:
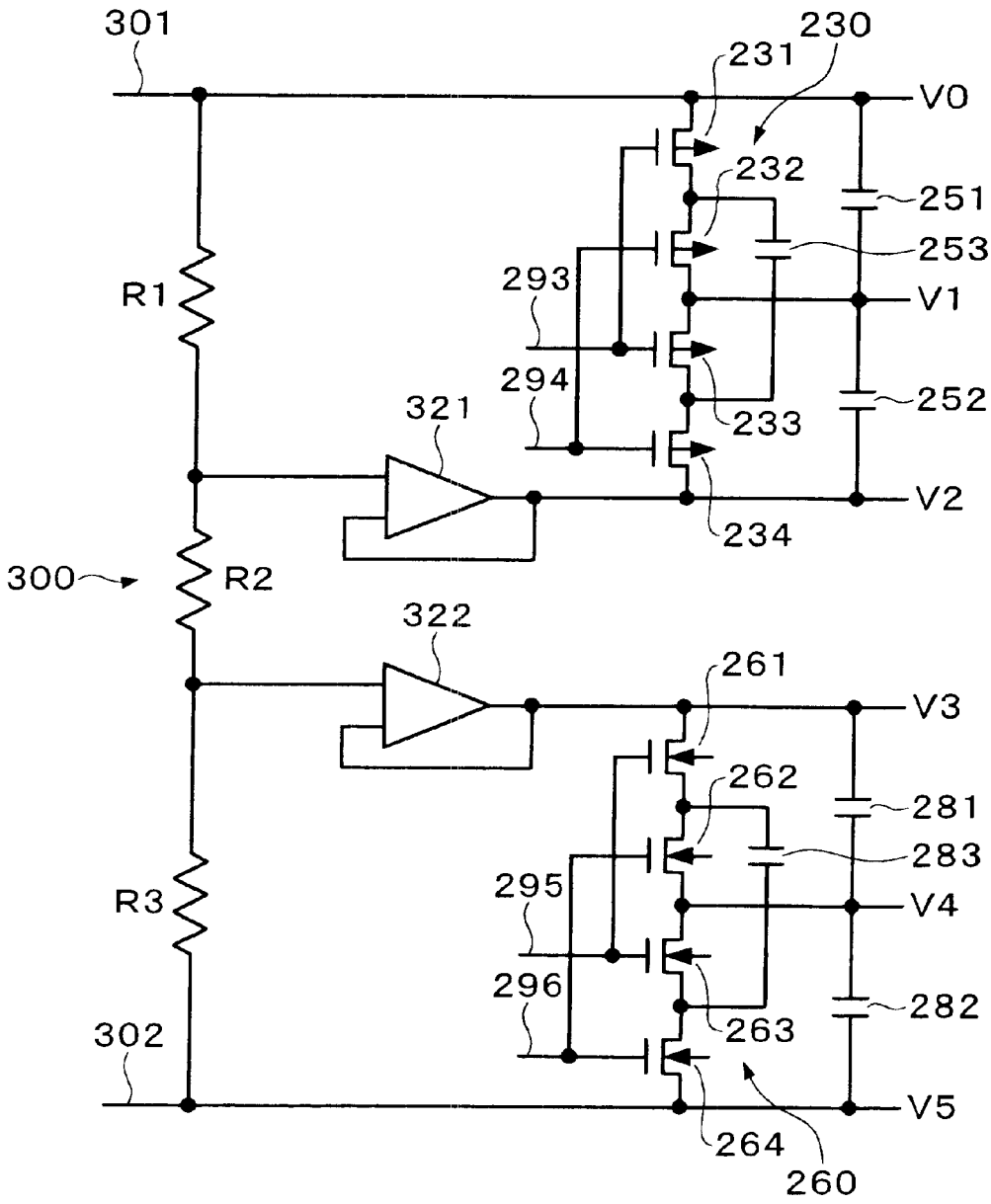
FIG. 17 is a circuit diagram of a power supply circuit for driving a liquid crystal in which the switches shown in FIG. 15 are formed by P-type MOS and N-type MOS transistors.

The first to fourth sub-switches 231 to 234 on the high-potential side in the power supply circuit shown in FIG. 15 each can be formed using a P-type MOS transistor as shown in FIG. 17. The fifth to eighth sub-switches 261 to 264 on the low-potential side in the circuit shown in FIG. 15 each can be formed using an N-type MOS transistor as shown in FIG. 17.

Figure 18:
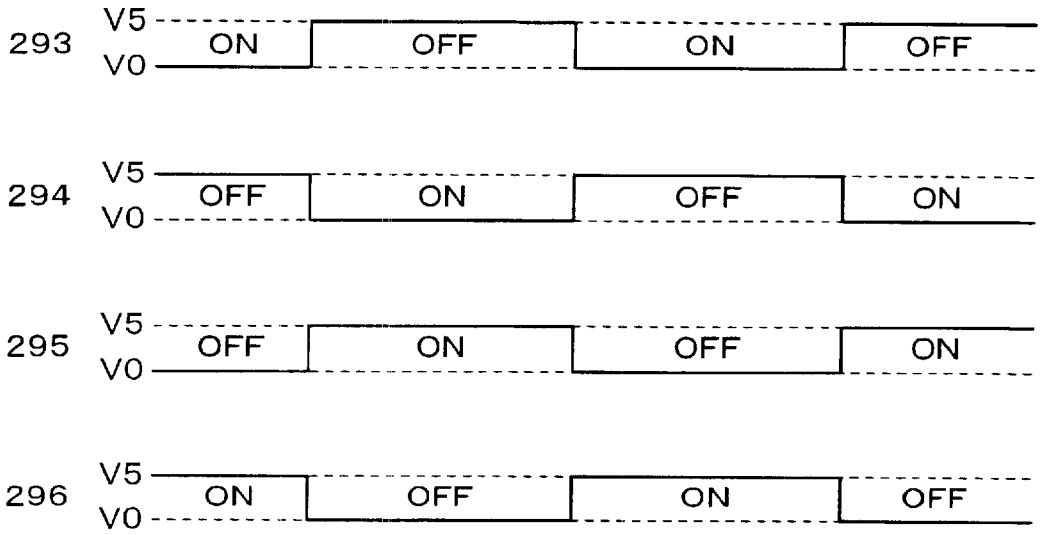
FIG. 18 is a timing chart of the signals supplied to the gates of the P-type MOS and N-type MOS transistors shown in FIG. 17.

The timing chart of the potential on the switch-driving signal lines 292 to 296 connected to the gates of the P-type MOS transistors 231 to 234 and N-type MOS transistors 261 to 264 is shown in FIG. 18.

As can be seen from FIG. 18, the on and off timing of each switch is as described above, and the potential of the gate of transistors 231 to 234 and 261 to 264 is switched alternately between the potential V0 of the first potential-supply line 301 and the potential V5 of the second potential-supply line 302.

Here, the potential of the well of the P-type MOS transistors 231 to 234 is V0, and that of the N-type MOS transistors 261 to 264 is V5. By setting the potential of the gate of the P-type MOS transistors 231 to 234 and that of the N-type MOS transistors 261 to 264 to potentials V1 and V5, it is possible to increase the voltage between the source and gate when each transistor is on.

The driving method shown in FIG. 18 allows a greater reduction in the size of the transistors, for example, in the width, for maintaining the same transistor performance, in comparison with another method in which, unlike the example of FIG. 18, the potential of the gate of the P-type MOS transistor 231 when the transistor is on is V2 and that of the N-type MOS transistor 261 when the transistor is on is V3, for example.

Figure 19:
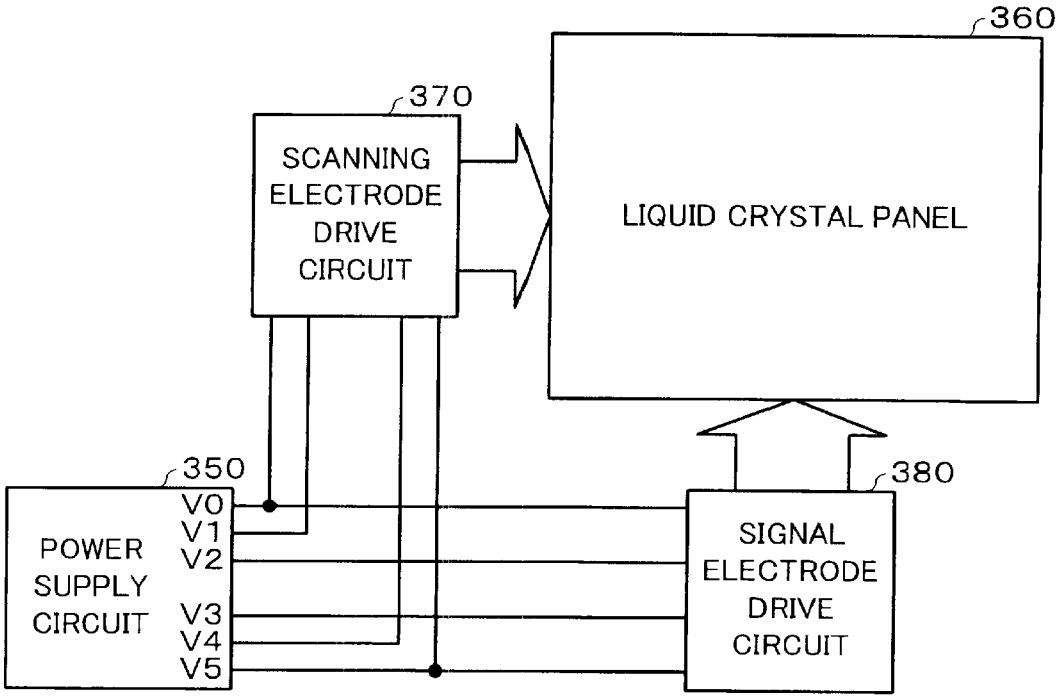
FIG. 19 is a block diagram of a liquid crystal device according to one embodiment of the present invention.
Figure 20:
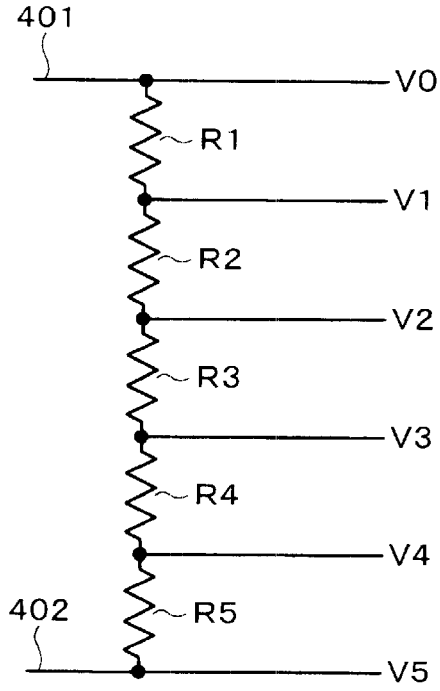
FIG. 20 is a circuit diagram of a conventional power supply circuit for driving a liquid crystal using resistor division.

FIG. 19 shows a liquid crystal device in which the power supply circuit for driving a liquid crystal of the present invention is used. The liquid crystal device comprises a power supply circuit 350 for driving a liquid crystal having the constitution shown in FIG. 15 or FIG. 17, for example, a liquid crystal panel 360 in which scanning electrodes and signal electrodes are formed, a scanning electrode drive circuit 370 which drives the scanning electrodes based on power supply from the power supply circuit 350 for driving a liquid crystal, and a signal electrode drive circuit 380 which drives the signal electrodes based on the power supply from the power supply circuit 350 for driving a liquid crystal.

In the case of a simple matrix-type liquid crystal device, the scanning electrode is called a common electrode and the signal electrode is called a segment electrode. It is needless to mention that the present invention is applicable to other drive systems such as an active matrix-type liquid crystal device, for example.

What is claimed is:

1. A power supply circuit for generating potentials used to drive a liquid crystal, the power supply circuit comprising:

a first to fourth switches connected in series between a high potential line and a low potential line;

a switch drive circuit which drives the first to fourth switches so that the period of time in which the first and third switches are on and the period of time in which the second and fourth switches are on alternate; and a plurality of capacitors of which connection state is switched alternately between series and parallel connections by a switching operation of the switch drive circuit, wherein a potential between the second and third switches converges to a middle potential between potentials of the high and low potential lines by a switching operation of the switch drive circuit, when first to third midpoints are midpoints of switch-intervals formed by being divided by the first to fourth switches, the power supply circuit includes:

a first capacitor connected between the high potential line and the second midpoint;

a second capacitor connected between the second midpoint and the low potential line; and a third capacitor connected between the first midpoint and the third midpoint, and the first and second capacitors are replaced by capacitors of a liquid crystal layer formed by supplying potentials of the high and low potential lines and the second midpoint to the liquid crystal layer.

2. A liquid crystal device comprising:

the power supply circuit for driving a liquid crystal according to claim 1;

a liquid crystal panel in which scanning electrodes and signal electrodes are formed;

a scanning electrode drive circuit which drives the scanning electrodes by receiving power supply from the power supply circuit for driving the liquid crystal; and a signal electrode drive circuit which drives the signal electrodes by receiving the power supply from the power supply circuit for driving the liquid crystal.

3. An electronic equipment comprising the liquid crystal device according to claim 1.

4. A power supply circuit for generating potentials used to drive a liquid crystal, the power supply circuit comprising:

a main power supply circuit generating a potential between potentials of a first potential-supply line and a second potential-supply line;

a first sub-power supply circuit generating a potential between potentials of the first potential-supply line and an output line of the main power supply circuit; and a second sub-power supply circuit generating a potential between potentials of the output line of the main power supply circuit and the second potential-supply line, wherein at least one of the main power supply circuit, first sub-power supply circuit, and second sub-power supply circuit comprises:

first to fourth switches connected in series between a high potential line and a low potential line;

a switch drive circuit which drives the first to fourth switches so that the period of time in which the first and third switches are on and the period of time in which the second and fourth switches are on alternate; and a plurality of capacitors of which the state of connection is switched alternately between series and parallel connections by a switching operation of the switch drive circuit, and wherein the potential between the second and third switches converges to a middle potential between the potentials of the high and low potential lines.

5. A power supply circuit for generating potentials used to drive a liquid crystal, the power supply circuit comprising:

first to fourth main switches connected in series between a first potential-supply line and a second potential-supply line;

first to fourth sub-switches connected in series between the first potential-supply line and a midpoint between the second and third main switches;

fifth to eighth sub-switches connected in series between a midpoint between the second and third main switches and the second potential-supply line;

a switch drive circuit which drives the first to fourth main switches and the first to eighth sub-switches so that a period of time in which the first and third main switches are on and a period of time in which the second and fourth main switches are on alternate, so that a period of time in which the first and third sub-switches are on and a period of time in which the second and fourth sub-switches are on alternate, and so that a period of time in which the fifth and seventh sub-switches are on and a period of time in which the sixth and eighth sub-switches are on alternate;

a first group of capacitors of which connection state is switched alternately between series and parallel connections by a switching operation of the first to fourth main switches;

a second group of capacitors of which connection state is switched alternately between series and parallel connections by a switching operation of the first to fourth sub-switches; and a third group of capacitors of which connection state is switched alternately between series and parallel connections by a switching operation of the fifth to eighth sub-switches, whereby a potential between the second and third main switches converges to a first middle potential between potentials of the first and second potential-supply lines, a potential between the second and third sub-switches converges to a second middle potential between the potential of the first potential-supply line and the first middle potential, and a potential between the sixth and seventh sub-switches converges to a third middle potential between the first middle potential and the potential of the second potential-supply line.

6. The power supply circuit, according to claim 5, wherein the first to fourth sub-switches are formed by P-type MOS transistors, and the fifth to eighth sub-switches are formed by N-type MOS transistors.

7. The power supply circuit, according to claim 6, wherein the switch drive circuit applies the potential of the first potential-supply line and the potential of the second potential-supply line alternately to gates of the P-type MOS and N-type MOS transistors to drive the first to eighth sub-switches.

8. A power supply circuit for generating potentials used to drive a liquid crystal, the power supply circuit comprising:

a plurality of resistors connected in series between a first potential-supply line and a second potential-supply line;

a first impedance-converting circuit to which a first potential at a first midpoint between adjacent two resistors is input to convert impedance of the first potential;

a second impedance-converting circuit to which a second potential at a second midpoint between other adjacent two resistors, which is lower than the potential at the first midpoint, to convert impedance of the second potential;

first to fourth switches connected in series between the first potential-supply line and an output line of the first impedance-converting circuit;

fifth to eighth switches connected in series between an output line of the second impedance-converting circuit and the second potential-supply line;

a switch drive circuit that drives the first to eighth switches so that a period of time in which the first and third switches are on and a period of time in which the second and fourth switches are on alternate, and so that a period of time in which the fifth and seventh switches are on and a period of time in which the sixth and eighth switches are on alternate;

a first group of capacitors of which connection state is switched alternately between series and parallel connections by a switching operation of the first to fourth switches; and a second group of capacitors of which connection state is switched alternately between series and parallel connections by a switching operation of the fifth to eighth switches, whereby a potential between the second and third switches converges to a first middle potential between potentials of the first potential-supply line and the output line of the first impedance-converting circuit, and the potential between the sixth and seventh switches converges to a second middle potential between potentials of the output line of the second impedance-converting circuit and the second potential-supply line.

9. The power supply circuit, according to claim 8, wherein the first to fourth switches are formed by P-type MOS transistors, and the fifth to eighth switches are formed by N-type MOS transistors.

10. The power supply circuit, according to claim 9, wherein the switch drive circuit applies the potential of the first potential-supply line and the potential of the second potential-supply line alternately to gates of the P-type MOS and N-type MOS transistors to drive the first to eighth switches.

* * * * *